US010316657B2

(12) United States Patent
Paramhans et al.

(10) Patent No.: US 10,316,657 B2
(45) Date of Patent: Jun. 11, 2019

(54) EXTENDABLE PROBE AND FORMATION TESTING TOOL AND METHOD

(71) Applicants: Shiva Paramhans, Houston, TX (US); David A. Hejl, Houston, TX (US); Russell W. Mceacharn, Houston, TX (US)

(72) Inventors: Shiva Paramhans, Houston, TX (US); David A. Hejl, Houston, TX (US); Russell W. Mceacharn, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 855 days.

(21) Appl. No.: 14/622,146

(22) Filed: Feb. 13, 2015

(65) Prior Publication Data

US 2016/0237817 A1 Aug. 18, 2016

(51) Int. Cl.
*E21B 49/08* (2006.01)
*E21B 49/10* (2006.01)

(52) U.S. Cl.
CPC ..... *E21B 49/10* (2013.01)

(58) Field of Classification Search
CPC ..... E21B 49/10
USPC ..... 166/250.17
See application file for complete search history.

(56) References Cited

U.S. PATENT DOCUMENTS 3,934,468 A * 1/1976 Brieger ..... E21B 49/10 73/152.25
2002/0060094 A1 5/2002 Meister et al.
2004/0160858 A1 8/2004 Ciglenec et al.
2004/0237640 A1 12/2004 Meister et al.
2011/0094733 A1* 4/2011 Proett ..... E21B 49/008 166/250.07

OTHER PUBLICATIONS

"Saturn 3D Radial Probe, Enabling, Efficient, Derisking, and flexible," Catalog, 2014, 24 pages, Schlumberger, Slb.com/Saturn.
International Search Report and Written Opinion; International Application No. PCT/US2016/017311; International Filing Date: Feb. 10, 2016; dated May 19, 2016; 12 Pages.

* cited by examiner

*Primary Examiner* — Anna M Momper
*Assistant Examiner* — Patrick F Lambe
(74) *Attorney, Agent, or Firm* — Cantor Colburn LLP

(57) ABSTRACT

An extendable probe for a formation testing tool includes a piston housing having a first diameter portion and a second diameter portion thereof. A piston including a piston base and a piston conduit. A piston base seal disposed between the piston base and the first diameter portion of the piston housing. The piston base seal representing an area; a piston conduit seal disposed between the piston conduit and the second diameter portion, the piston conduit seal representing an area. A pin in operative communication with the piston housing and extending though the piston; a pin seal disposed between the pin and the piston base, the pin seal representing an area; and wherein the piston conduit seal. Piston base seal and pin seal each are configured to adhere to the equation: piston conduit seal area=piston base seal area−pin seal area. A method for querying a formation fluid.

11 Claims, 3 Drawing Sheets

EXTENDABLE PROBE AND FORMATION TESTING TOOL AND METHOD

BACKGROUND

In downhole industries such as hydrocarbon exploration and recovery, Carbon Dioxide sequestration, etc., it is often valuable for an operator to measure various formation and or fluid parameters. Such tools are commonly run on wireline but can be conveyed on any string. In one example, fluid mobility in the formation is tested by withdrawing a volume of fluid therefrom through a probe and analyzing drawdown pressures to determine the mobility of that fluid. Equations used by the industry are common and standard and are configured to address variables that are encountered. This unfortunately makes output information good but not optimum since variables inject a measure of uncertainty into the mix.

Many different formation testing tools have been used for such endeavors through the years and in general they work well for their intended purposes. Many however are also quite complex and relatively expensive to construct. They are also reliant upon positive hydraulic fluid pressure to extend and to retract thereby necessitating ported hydraulic fluid to different chambers of a piston system. Some of the complexity and engineering requirements of prior tools are driven by these considerations. Further, due to complexity, there are often multiple failure opportunities that require frequent maintenance and may cause downtime for operating tools.

Due to the above mentioned drawbacks of existing tools, the art is always receptive to improvements in such tools.

SUMMARY

An extendable probe for a formation testing tool includes a piston housing having a first diameter portion and a second diameter portion thereof; a piston including a piston base and a piston conduit; a piston base seal disposed between the piston base and the first diameter portion of the piston housing, the piston base seal representing an area; a piston conduit seal disposed between the piston conduit and the second diameter portion, the piston conduit seal representing an area; a pin in operative communication with the piston housing and extending though the piston; a pin seal disposed between the pin and the piston base, the pin seal representing an area; and wherein the piston conduit seal, piston base seal and pin seal each are configured to adhere to the equation: piston conduit seal area=piston base seal area−pin seal area.

A method for querying a formation fluid including extending the extendable probe of an extendable probe for a formation testing tool includes a piston housing having a first diameter portion and a second diameter portion thereof; a piston including a piston base and a piston conduit; a piston base seal disposed between the piston base and the first diameter portion of the piston housing, the piston base seal representing an area; a piston conduit seal disposed between the piston conduit and the second diameter portion, the piston conduit seal representing an area; a pin in operative communication with the piston housing and extending thought the piston; a pin seal disposed between the pin and the piston base, the pin seal representing an area; and wherein the piston conduit seal, piston base seal and pin seal each are configured to adhere to the equation: piston conduit seal area=piston base seal area−pin seal area; contacting a formation; withdrawing fluid from the formation; calculating mobility without a volume variable.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
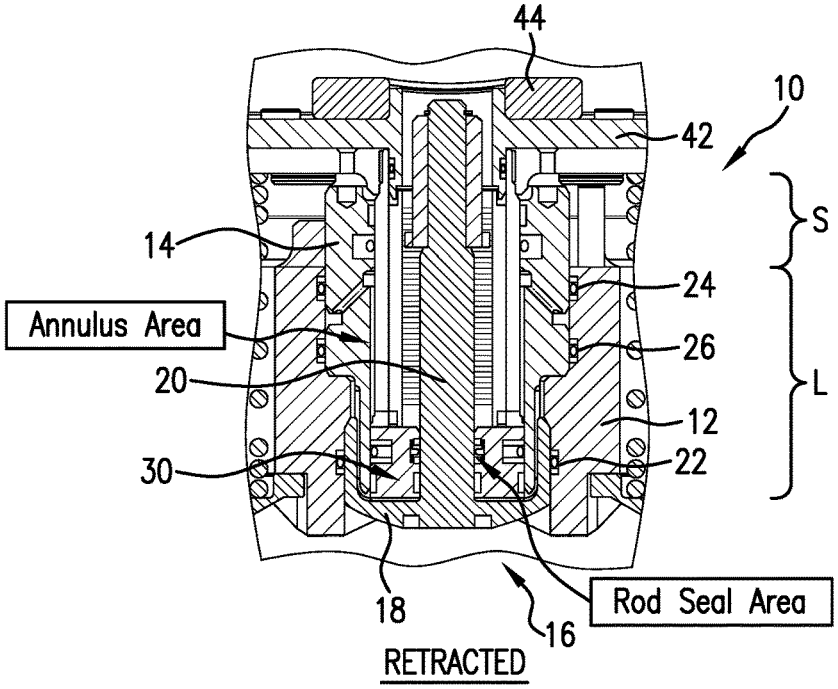
FIG. 1 is a cross sectional representation of an extendable probe as disclosed herein in a retracted position.
Figure 2:
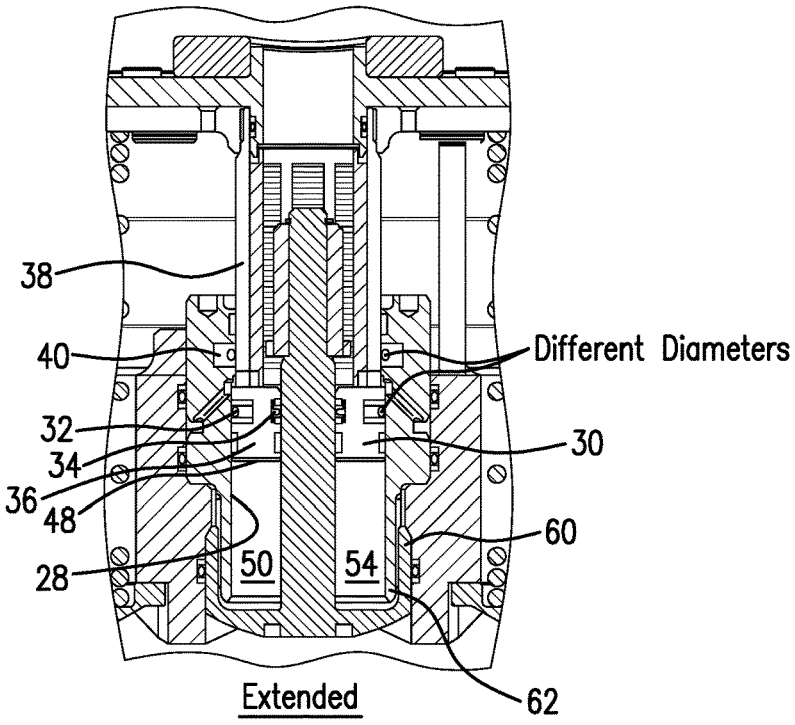
FIG. 2 is a cross sectional representation of an extendable probe as disclosed herein in an extended position.
Figure 3:
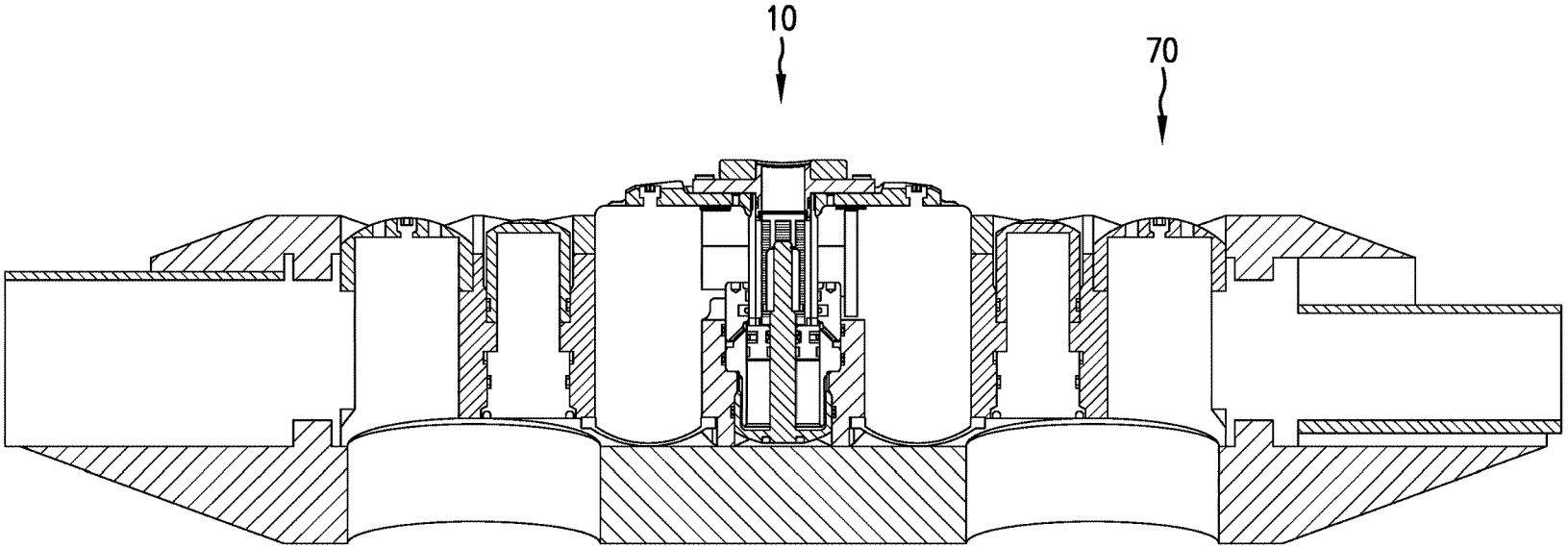
FIG. 3 is a cross sectional schematic representation of a formation testing tool in which the extendable probe is disposed.

Referring to FIGS. 1 and 2 simultaneously, an extendable probe 10 is illustrated. The probe 10 as illustrated is configured to maintain constant volume in a sample fluid and to maintain balanced pressure regardless of the degree of extension of the probe 10. These results will be further explained below after introduction of the components of the probe 10.

The probe 10 comprises a probe housing 12 within which a piston housing 14 is disposed. Attached in sealed relation to the probe housing 12 is pin member 16 that itself comprises a cap 18 and a pin 20. Cap 18 is sealed to probe housing 12 via seal 22, which as illustrated is in the form of an o-ring with backups but it will be understood that other seal types could be substituted. It is to be understood that other seals referred to herein are also illustrated as o-ring seals with backups but could be configured as other types of seals. The piston housing 14 is sealed to the probe housing 12 at seals 24 and 26. Within a bore 28 of piston housing 14 is piston 30 that is sealed to the piston housing at several places as discussed hereunder. Piston 30 is configured to move within the bore 28 to effect the extended and retracted positions of the probe 10. Piston 30 is sealed to bore 28 by piston base seal 32 and to pin 20 by pin seal 34. It is to be noticed that the bore 28 though piston housing 14 is configured with two different diameters. A first diameter is denoted L and a second diameter is denoted S in FIG. 1, L being a larger diameter than S. First diameter L cooperates with a piston base 36, sealed as noted by piston base seal 32 and diameter S cooperates with a piston conduit 38 of the piston 30 sealed by piston conduit seal 40. Axiomatically, the piston base 36 is of a larger diameter than the piston conduit 38. Seals 32, 34 and 40 are instrumental in achieving the benefits of the invention and will be addressed further below.

Figure 4:
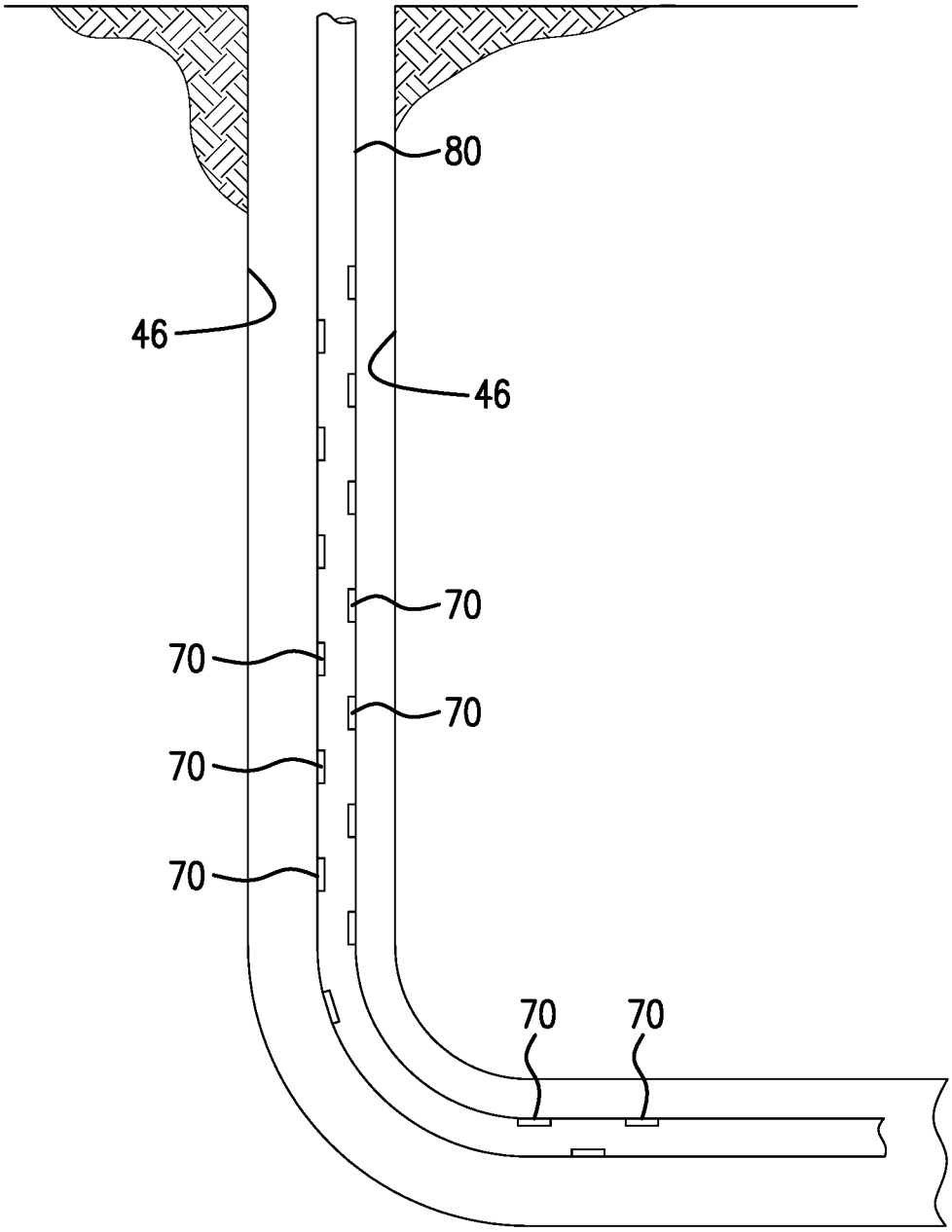
FIG. 4 is a schematic representation of a wireline string in which a plurality of formation testing tools are disposed depicted in a borehole.

To complete the introduction of components of the probe 10, piston conduit 38 extends from piston base 36 to a packer support 42, which itself supports a packer 44. It is the duty of packer 44 to seal against a formation wall 46 (FIG. 4) when the extendable probe 10 is in use in a manner similar to probes of the prior art.

The present inventors have solved the drawbacks of prior art probes mentioned in the background section above by configuring probe 10 in a manner that simplifies the extension and retraction operation while at the same time ensures constant volume and force balance in the tool, thereby enabling better calculations by removing uncontrollable variables. This is achieved by configuring piston 30 such that the piston base 36 and the piston conduit 38 have different diameters. The diameters of piston base 36 and piston conduit 38 are selected to cooperate with diameters L and S of the piston housing 14. The diameters are selected such that seal areas present in the probe can be balanced against each other to produce a net zero effect for volume and force upon movement of the piston 30 in the piston housing 14. More specifically, the seals and components are configured such that an area of piston conduit seal 40=area of piston base seal 32−area of pin seal 34. In this way, the volume defined within the piston conduit 38 does not change with the degree of extension of the probe 10. As such, the previously accepted equation for mobility that included volume as a variable can be simplified with volume as a constant. It will be understood that other volumes associated with fluid samples in the probe and tool are already constant and hence do not require discussion.

Probe 10 benefits from actuation that is distinct from more complex configurations of the prior art. Extension and retraction of probe 10 are both affected from a single fluid source acting solely on one area 48 of piston 30. Applied fluid pressure against area 48 causes the probe to extend until packer 44 contacts a formation wall (not shown). Where fluid pressure is increased above environmental pressure, the probe 10 will extend. Where fluid pressure is reduced below environmental pressure, the probe 10 will retract. In other words, the configuration allows the probe to be pushed out with fluid pressure and sucked back in with a relatively negative pressure. Particularly due to the configuration of probe 10 as set forth herein, the ability to retract the probe 10 simply by creating an underbalanced pressure condition in a volume 50 relative to a pressure condition on the opposite side of seals 32 and 34 leaves opposing surface areas of seals 32, 34 and 40 to be used for volume and pressure balancing considerations rather than extension and retraction actuation considerations as in the prior art.

Hydraulic fluid ingress and egress to volume 50 is provided through port 54 illustrated in broken lines in FIG. 2 because it is behind piston housing 14 in this view. It is to be appreciated that the port 54 accesses volume 50 between seals 26 and 22 and fluid migrates between a shoulder portion 60 of cap 18 and a skirt portion 62 of piston housing 14.

Directly connected to the volume constancy of probe 10 is a force balance. Because of the consideration of area of the seals as set forth in the equation above, the force in volume 50 will remain at a set point regardless of pressure on the opposite side of seals 32 and 34. This removes the requirement for the fluid pressure source to have compensating criteria in its control system which reduces complexity of the overall formation testing tool. Accordingly, the configuration of probe 10 to provide for piston conduit seal 40 area=piston base seal 32 area−pin seal 34 area enables both constant volume and force balance. Force balance is helpful to avoid the overall formation testing tool 70 being forced to extend from a wireline string 80 (see FIG. 4) with which it has been deployed.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. An extendable probe for a formation testing tool comprising:

a piston housing having a first diameter portion and a second diameter portion thereof;

a piston including a piston base and a piston conduit;

a piston base seal disposed between the piston base and the first diameter portion of the piston housing, the piston base seal having an area;

a piston conduit seal disposed between the piston conduit and the second diameter portion, the piston conduit seal having an area;

a pin in operative communication with the piston housing and extending though the piston;

a pin seal disposed between the pin and the piston base, the pin seal having an area;

and wherein the piston conduit seal, piston base seal and pin seal each are configured to adhere to the equation: piston conduit seal area=piston base seal area−pin seal area to produce a net zero effect for volume and force upon movement of the piston in the piston housing.

2. The extendable probe as claimed in claim 1 wherein the first diameter is larger than the second diameter.

3. The extendable probe as claimed in claim 1 wherein the piston base exhibits a diameter larger than a diameter of the piston conduit.

4. The extendable probe as claimed in claim 1 wherein one or more of the piston base seal, the piston conduit seal and the pin seal comprises an o-ring.

5. A Formation Testing Tool comprising the extendable probe of claim 1.

6. A formation testing system comprising:

a string;

one or more extendable probes as claimed in claim 1.

7. A method for querying a formation fluid comprising:

extending the extendable probe of claim 1;

contacting a formation;

withdrawing fluid from the formation;

calculating mobility without a volume variable.

8. The method of claim 7 further comprising retracting the extendable probe.

9. The method of claim 8 wherein the extending and the retracting are affected by a single pressure source acting on the piston base on one area.

10. The method of claim 7 further comprising force balancing the extendable probe by adherence to the equation piston conduit seal area=piston base seal area−pin seal area.

11. The method of claim 7 further comprising maintaining volume constancy regardless of position of the extendable probe by adherence to the equation piston conduit seal area=piston base seal area−pin seal area.

* * * * *